US005955832A

United States Patent [19]

Tomita et al.

[11] Patent Number: 5,955,832

[45] Date of Patent: Sep. 21, 1999

[54] VACUUM ENVELOPE HAVING NIOBIUM OXIDE GATE ELECTRODE STRUCTURE

[75] Inventors: Masaharu Tomita; Shigeo Itoh; Hisataka Ochiai; Tsuyoshi Inukai, all of Mobara, Japan

[73] Assignee: Futaba Denshi Kogyo K.K., Mobara, Japan

[21] Appl. No.: 08/970,106

[22] Filed: Nov. 13, 1997

[30] Foreign Application Priority Data

Nov. 22, 1996 [JP] Japan ..... 8-325879

[51] Int. Cl.[6] ..... H01J 1/62

[52] U.S. Cl. ..... 313/495; 313/309; 313/310

[58] Field of Search ..... 313/495, 309, 313/310, 336, 351

[56] References Cited

U.S. PATENT DOCUMENTS 5,650,689 7/1997 Itoh et al. ..... 313/310

*Primary Examiner*—Vip Patel

*Attorney, Agent, or Firm*—Oblon, Spivak McClelland, Maier & Neustadt, P.C.

[57] ABSTRACT

A vacuum envelope with a built-in electron source capable of preventing peeling of gate electrodes, to thereby enhance reliability in operation over a long period of time and reducing a manufacturing cost thereof. The gate electrodes each are made of niobium oxide or niobium nitride. Nb for the gate electrode is previously oxidized or nitrided to prevent progress of oxidation of the gate electrode due to release of oxygen from lead oxide contained in a seal material during heating for sealing, resulting in expansion of the gate electrode. An insulating layer is formed on a cathode substrate and the gate electrodes are formed on the insulating layer. Then, the seal material is applied onto the insulating layer so as to cover a part of each of the gate electrodes, so that the cathode substrate may be sealedly joined to an anode substrate.

4 Claims, 6 Drawing Sheets

VACUUM ENVELOPE HAVING NIOBIUM OXIDE GATE ELECTRODE STRUCTURE

BACKGROUND OF THE INVENTION

This invention relates to a vacuum envelope having an electron source incorporated therein, and more particularly to a vacuum envelope with a built-in electron source which is suitable for use for a field emission device (hereinafter also referred to as "FED") and a method for manufacturing the same.

Recently, vacuum microelectronics provided by semiconductor fine-processing techniques have come to notice in the art, which are constructed in such a manner that a cold cathode is incorporated in a vacuum envelope made of glass or the like and vacuum microstructures of a size as small as microns are integrated. The vacuum microelectronics have been applied to research and development of a vacuum envelope with a built-in electron source for an active element, various sensors for detecting magnetism or the like, an image pickup device, an electron beam unit for lithography, a thin-type flat panel display unit or the like.

The thin-type flat panel display unit is constructed so as to arrange a plurality of fine cold cathodes for every picture cell. The fine cold cathodes which have been proposed in the past include those constructed of a field emission cathode, an MIM type electron emission element, a surface conduction type electron emission element, a PN junction type electron emission element and the like. Of the fine cold cathodes proposed, the most typical one is an FED including field emission cathodes, as disclosed in Nikkei Electronics, No. 654 (Jan. 29, 1996), pp 89–98. Field emission is a phenomenon that when an electric field set to be about $10^9$ V/m is applied to a surface of a metal material or that of a semiconductor material, a tunnel effect occurs to permit electrons to pass through a barrier, resulting in the electrons being discharged to a vacuum even at a normal temperature. Such electron field cathodes include an electron emission cathode of the Spindt type by way of example.

The MIM type electron emission element is constructed of a lamination structure wherein a metal layer, a thin insulating layer and a thin metal layer are laminated on each other in order. The MIM type electron emission element thus constructed is operated in a manner to apply a voltage between both metal layers to cause electrons to be emitted from the thin metal layer. The electron emission element of the surface conduction type is so constructed that two electrodes and a high-resistance thin film layer are formed on an insulating layer, wherein a voltage is applied between both electrodes to cause electrons to be emitted from the high-resistance thin film layer arranged between both electrodes. The PN junction type electron emission element is constructed so as to utilize avalanche breakdown. Alternatively, it may be constructed so as to apply a voltage to a PN junction in a forward direction to cause electrons injected into a P-layer to be emitted from a surface of the P-layer.

Referring now to FIG. 6, a basic structure of the Spindt type FED is illustrated. In FIG. 6, reference numeral 1 designates a cathode substrate, 2 is an insulating layer, 51 is cathode electrodes, 52 is gate electrodes, 53 is apertures, 54 is an anode substrate, 55 is an anode electrode, A is an anode lead-out wiring, C1 to Cn are cathode lead-out wirings, and G1 to Gm are gate lead-out wirings.

The cathode electrodes 51 are arranged in a stripe-like manner on the cathode substrate 1 and then the insulating layer 2 is deposited all over the cathode substrate 1 including the cathode electrodes 51. Then, the gate electrodes 52 are formed in a stripe-like manner on the insulating layer 2 while extending in a direction perpendicular to the cathode electrodes 51 and in parallel to each other. A plurality of the apertures 53 are formed at each of intersections between the cathode electrodes 51 and the gate electrodes 52 in a manner to commonly pass through the gate electrode 52 and the insulating layer 2 below the gate electrode 52. The apertures 53 each are formed therein with an emitter 57 of a conical shape while being arranged on the cathode electrode 51, as described hereinafter with reference to FIG. 8. A resistive layer may be often formed between the cathode electrodes 51 and the insulating layer 2.

The anode electrode 55 is arranged on a lower surface of the anode substrate 54 made of a transparent glass material or the like. The anode electrode 55 is formed on a lower surface thereof with a phosphor layer (not shown). The Spindt type FED also includes a drive circuit (not shown) which functions to apply an anode voltage through the anode lead-out wiring A to the anode electrode 55, feed an image signal through the cathode lead-out wirings C1 to Cn to the cathode electrodes 51 and feed a drive signal through the gate lead-out wirings G1 to Gm to the gate electrodes 52.

In the Spindt type FED thus constructed, the gate electrodes 52 are scanned in order and the cathode electrodes 51 are fed with an image signal while keeping an anode voltage applied to the anode electrode 55, to thereby permit the emitters arranged in the apertures 53 to emit electrons, which are impinged on the phosphor arranged on the anode electrode 55, resulting in luminescence of the phosphor.

FIG. 7 is a schematic plan view of the Spindt type FED. In FIG. 7, reference numeral 4 designates a seal material and 56 is insulating studs. A plurality of such insulating studs 56 are vertically arranged on the insulating layer 2 to hold the cathode substrate 1 and anode substrate 54 spaced from each other at a predetermined interval therebetween while ensuring that both substrates withstand an atmospheric pressure applied thereto, with the insulating studs 56 being interposed therebetween. Then, the seal material 4 of a low melting point such as seal glass (frit glass) or the like which is arranged between both substrates 1 and 54 is heated to sealedly join both substrates 1 and 54 to each other, to thereby provide an envelope, which is then evacuated to a high vacuum.

The cathode substrate 1 and anode substrate 54 are superposed on each other while being deviated from each other in an oblique direction and while being spaced from each other at a predetermined interval and are hermetically joined to each other by means of the seal material 4. In FIG. 7, the seal material 4 is arranged somewhat inside an outer contour of a superposed area between both substrates 1 and 54 and in a predetermined width. Actually, the seal material 4 is arranged so as to extend to the contour or a vicinity to the contour.

A region in the thus-formed envelope on which the anode electrode 55 is arranged functions as an image display region. In a left-side region of the cathode substrate 1 positioned outside the seal material 4 in FIG. 7, terminal sections of the cathode electrodes 51 are led out to form the cathode lead-out wirings C. Likewise, the gate electrodes 52 have terminal sections led out in an upper region of the cathode substrate 1 positioned outside the seal member 4 in FIG. 7, resulting in the gate lead-out wirings G. Further, in a right-side region of the anode substrate 54 positioned outside the seal material 4, the anode lead-out wirings A are formed so as to extend from the anode electrode 55. The cathode substrate 1 and anode substrate 54 are arranged so as to be spaced from each other at a reduced interval while being opposite to each other, so that it is physically substantially impossible to carry out both connection of the cathode substrate 1 to the drive circuit and that of the anode substrate 54 thereto at the same position. Thus, the respective lead-out wirings are formed so as to extend in directions different from each other as described above.

Expansion of the above-described monochrome FED permits a color FED of the primary colors to be realized, although it is not shown in FIG. 7 for the sake of brevity. More specifically, in this instance, a plurality of such anode electrodes 55 are arranged in a stripe-like manner in correspondence to luminous colors of phosphors for the primary colors and connected to a plurality of anode lead-out wirings different from each other, respectively.

Such a conventional Spindt type FED as described above may be constructed in such a manner as shown in FIG. 8 by way of example, which corresponds to a fragmentary sectional view taken along one of the gate electrodes in FIG. 7. In FIG. 8, reference numeral 57 designates emitters. The cathode substrate 1 made of glass or the like is provided thereon with the cathode electrodes 51, which are made of metal and arranged so as to extend in a direction perpendicular to the sheet of FIG. 8. Then, the insulating layer 2 formed of a silicon dioxide ($SiO_2$) film or the like is deposited all over the cathode substrate 1 to cover the cathode electrodes 51. The insulating layer 2 is formed into a thickness of about 1 $\mu$m.

Then, the gate electrodes 52 are formed into a thickness of about 0.2 $\mu$m on the insulating layer 2 so as to extend in a direction perpendicular to the cathode electrodes 51. The apertures 53 formed so as to commonly extend through the gate electrode 52 and insulating layer 2 each have the emitter 57 of a conical shape arranged therein. The emitters 57 each are made of metal such as molybdenum or the like and formed on the cathode electrode 51. The emitters 57 each are exposed at a distal end thereof through the aperture 53 while being directed toward the anode electrode 55.

The emitters 57 are arranged at pitches of 10 $\mu$m or less, so that tens of thousands to hundreds of thousands of such emitters may be arranged on one such cathode substrate 1. Also, the emitters 57 may be so arranged that a distance between the gate electrode 52 and the distal end of the emitter 57 is set to be as small as less than a micron, so that application of a voltage as low as tens of volts between the gate electrodes 52 and the emitters 57 permits electrons to be field-emitted from the emitters 57. Thus, in the conventional Spindt type FED, the cathode electrodes 51, emitters 57 and gate electrodes 52 cooperate with each other to provide an electrode source. Thus, when a positive voltage is kept applied to the anode electrode 55 shown in FIG. 6, the anode electrode 55 captures electrons emitted from the emitters 57, so that the phosphor provided on the anode electrode 55 emits light.

As described above with reference to FIG. 6, the cathode substrate 1 and anode substrate 54 are so arranged that an interval therebetween is kept at, for example, 0.2 mm, resulting in the envelope being provided and the insulating studs 56 and seal material 4 are arranged between the substrates 1 and 54 to form a high vacuum in the envelope. The gate electrodes 52 are required to be arranged both inside and outside the sealed portion of the envelope defined by the seal material 4, so that the seal material 4 is caused to be contacted with the gate electrodes 52.

FIGS. 9(A) and 9(B) each are a sectional view taken along line A—A of FIG. 8 showing a construction employed for solving the above-described problem of the FED shown in FIG. 8; wherein FIG. 9(A) shows the gate electrode in an ideal state and FIG. 9(B) shows it after a heat treatment.

In FIGS. 9(A) and 9(B), the gate electrodes 52 are conventionally made of niobium (Nb). In general, Nb is increased in adhesion to glass or the like, to thereby be readily used as compared with tungsten, so that a pattern of the gate electrodes 52 may be formed by dry etching. In this connection, the gate electrodes made of Nb should be inherently kept adhered onto the insulating layer 2 even after the heat treatment; however, heating of the gate electrodes 52 to a temperature of about 500° C. causes the gate electrodes of the lead-out sections to be oxidized by the frit glass seal material used for hermetically sealing the envelope as shown in FIG. 9(B). This causes the gate electrodes 52 to be peeled from the insulating layer 2, resulting in the seal material 4 entering therebetween, leading to formation of a gap 58. The gap 58 thus formed causes a slow leak phenomenon which causes a vacuum in the envelope to be gradually reduced over a long period of time. Also, the oxidation leads to an increase in resistance of the gate electrodes 52 or breakage thereof, leading to a failure in conduction thereof.

FIG. 10 shows another manner in which the conventional Spindt type FED may be constructed. In the example of FIG. 10, the gate electrodes 52 each are formed on a portion thereof contacted with the seal material 4 with a protective film 61 for protecting the gate electrode 52. The protective film 61 is formed of silicon dioxide ($SiO_2$) into a thickness of about 1 to 2 $\mu$m. Such arrangement of the protective film 61 effectively prevents peeling of the gate electrode 52 from the insulating layer 2.

Unfortunately, pattern-formation of the protective film 61 on only the portion of the gate electrode 52 on which the seal material 4 is formed leads to an increase in the number of steps in manufacturing of the FED and complication of a manufacturing process thereof. More particularly, steps for formation of the protective film 61 and for patterning thereof are additionally required.

SUMMARY OF THE INVENTION

Accordingly, it is an object of the present invention to provide a vacuum envelope with a built-in electron source which is capable of exhibiting increased reliability in operation over a long period of time.

It is another object of the present invention to provide a vacuum envelope with a built-in electron source which is capable of facilitating manufacturing thereof.

It is a further object of the present invention to provide a vacuum envelope with a built-in electron source which is capable of reducing a manufacturing cost thereof.

In accordance with one aspect of the present invention, a vacuum envelope with a built-in electron source is provided. The vacuum envelope includes a cathode substrate formed thereon with an electron source and sealedly joined to another substrate by welding by means of a seal material to form a sealed space between the substrates. The electron source includes gate electrodes which are led out through a welded portion between the substrates. The sealed space is evacuated to a vacuum atmosphere. The gate electrodes each have at least a portion which passes through the welded portion made of one of niobium oxide and niobium nitride.

In accordance with this aspect of the present invention, a vacuum envelope with a built-in electron source includes a cathode substrate formed thereon with an electron source and sealedly joined to another substrate by welding by means of a seal material to form a sealed space between the substrates. The electron source includes gate electrodes, which are led out through a welded portion between the substrates. The sealed space is evacuated to a vacuum atmosphere. The gate electrodes each have at least a surface which is contacted with the seal material made of one of niobium oxide and niobium nitride.

In accordance with another aspect of the present invention, a method for manufacturing a vacuum envelope with a built-in electron source is provided. The method comprises the steps of sealedly joining a cathode substrate formed thereon with an electron source to another substrate by welding by means of a seal material to form a sealed space between the substrates, leading out gate electrodes of said electron source through a welded portion between the substrates, and evacuating the sealed space to a vacuum atmosphere. The gate electrodes each are made by forming a niobium film, subjecting the niobium film to patterning and subjecting at least a surface of at least a portion of the niobium film contacted with the seal material to an oxidizing or nitriding treatment.

In accordance with this aspect of the present invention, a method for manufacturing a vacuum envelope with a built-in electron source is also provided. The method comprises the steps of sealedly joining a cathode substrate formed thereon with an electron source to another substrate by welding by means of a seal material to form a sealed space between the substrates, leading out gate electrodes of the electron source through a welded portion between the substrates, and evacuating the sealed space to a vacuum atmosphere. The gate electrodes each are made by forming a niobium film, subjecting at least a surface of at least a portion of the niobium film contacted with the seal material to an oxidizing or nitriding treatment and subjecting the niobium film to patterning.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which like reference characters designate like or corresponding parts throughout; wherein.

DETAILED DESCRIPTION OF THE PREFERRED EMBODIMENTS

Now, a vacuum envelope with a built-in electron source according to the present invention will be described hereinafter with reference to FIGS. 1 to 5.

Figure 1:
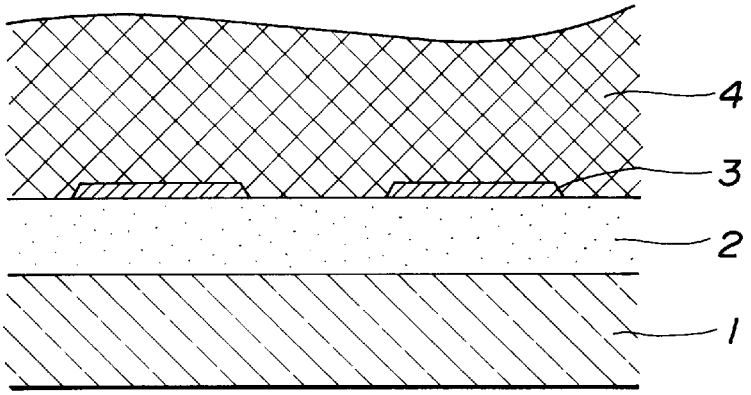
FIG. 1 is a schematic fragmentary sectional view showing an essential part of a first embodiment of a vacuum envelope with a built-in electron source according to the present invention.
Figure 9A:
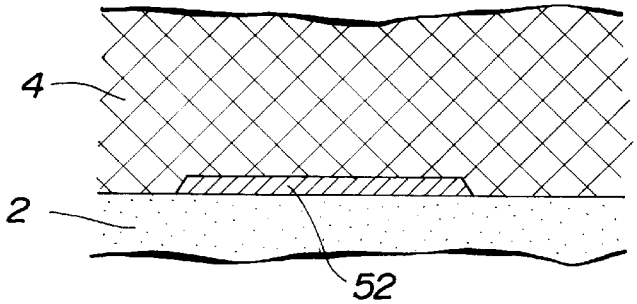
FIG.9(A) (PRIOR ART)
FIGS. 9(A) and 9(B) each are a schematic view showing a problem encountered with the conventional Spindt type FED of FIG. 8.

Referring first to FIG. 1, a first embodiment of a vacuum envelope with a built-in electron source according to the present invention is illustrated. FIG. 1 is a sectional view similar to FIGS. 9(A) and 9(B) described above, wherein reference numeral 3 designates gate electrodes.

Figure 9B:
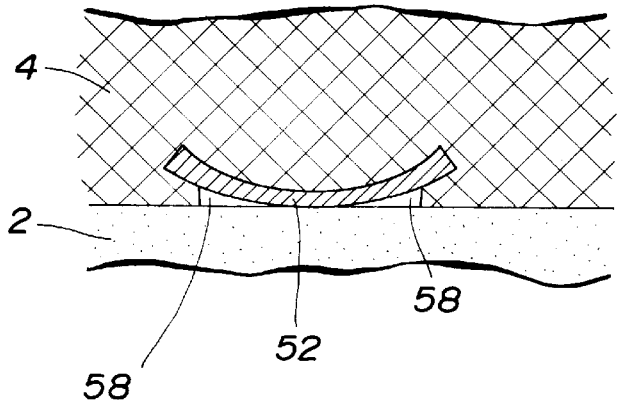
FIG.9(B) (PRIOR ART)

The inventors made an analysis of the peeled Nb film shown in FIG. 9(B) and as a result, it was found that peeling of the gate electrode 52 shown in FIG. 9(B) is essentially caused due to cubic expansion of the gate electrode 52 by oxidation of Nb rather than a difference in thermal expansion between the gate electrode 52 and the seal material 4. The seal material 4 contains in addition to silicon dioxide ($SiO_2$), lead oxide and lead titanate ($PbTiO_2$) in order to reduce a melting point thereof or adjust a thermal expansion coefficient thereof.

In FIG. 9(B), it would be considered that when a heat treatment is carried out in order to join the cathode substrate and anode substrate to each other, oxygen contained in the lead oxide moves toward the gate electrode 52 on an interface of contact between the cathode substrate and the anode substrate, to thereby bond to Nb of the gate electrode to form niobium oxide (Nb—O), which is subject to cubic expansion in the heat treatment, resulting in the gap 58 being formed. A seal material decreased in content of lead oxide is commercially available. However, it is increased in melting point, resulting in being unsuitable for use for the FED. Also, when an additive like lead oxide which releases oxygen when it is subject to a heat treatment is contained in the seal material, a like disadvantage is caused.

The vacuum envelope of the illustrated embodiment is so constructed that the gate electrodes 3 each are made of niobium oxide (Nb—O) or niobium nitride (NbN), unlike the first example of the conventional vacuum envelope described above with reference to FIG. 8. Nb contained in a material for the gate electrode 3 is previously oxidized or nitrided, to thereby prevent progress of oxidation of the material due to oxygen released from lead oxide or the like contained in a seal material 4 during heating of the seal material for formation of an envelope, to thereby eliminate expansion of the gate electrode 3 by oxidation of Nb, resulting in preventing peeling of the gate electrode 3 and a failure in conduction thereof. The gate electrodes 3 may be formed into a thickness of 0.2 to 0.4 $\mu$m. An insulating layer 2 is formed on a cathode substrate 1 and then the seal material 4 is arranged on the insulating layer 2 including a portion thereof on which the gate electrodes 3 are provided. The seal member 4 permits an anode substrate (not shown) formed in substantially the same manner as the anode substrate 54 shown in FIGS. 6 and 7 to be sealedly joined to the cathode substrate 1.

Niobium nitride exhibits increased resistance to chemicals as compared with niobium oxide. Resistance of the niobium nitride to chemicals is equal to or above that of niobium. Although niobium oxide and niobium nitride are increased in resistivity as compared with niobium, increased resistivity of the niobium oxide or niobium nitride does not adversely affect use of niobium nitride for the gate electrode 3 because it is not required to flow a large amount of current through the gate electrode 3.

Figure 7:
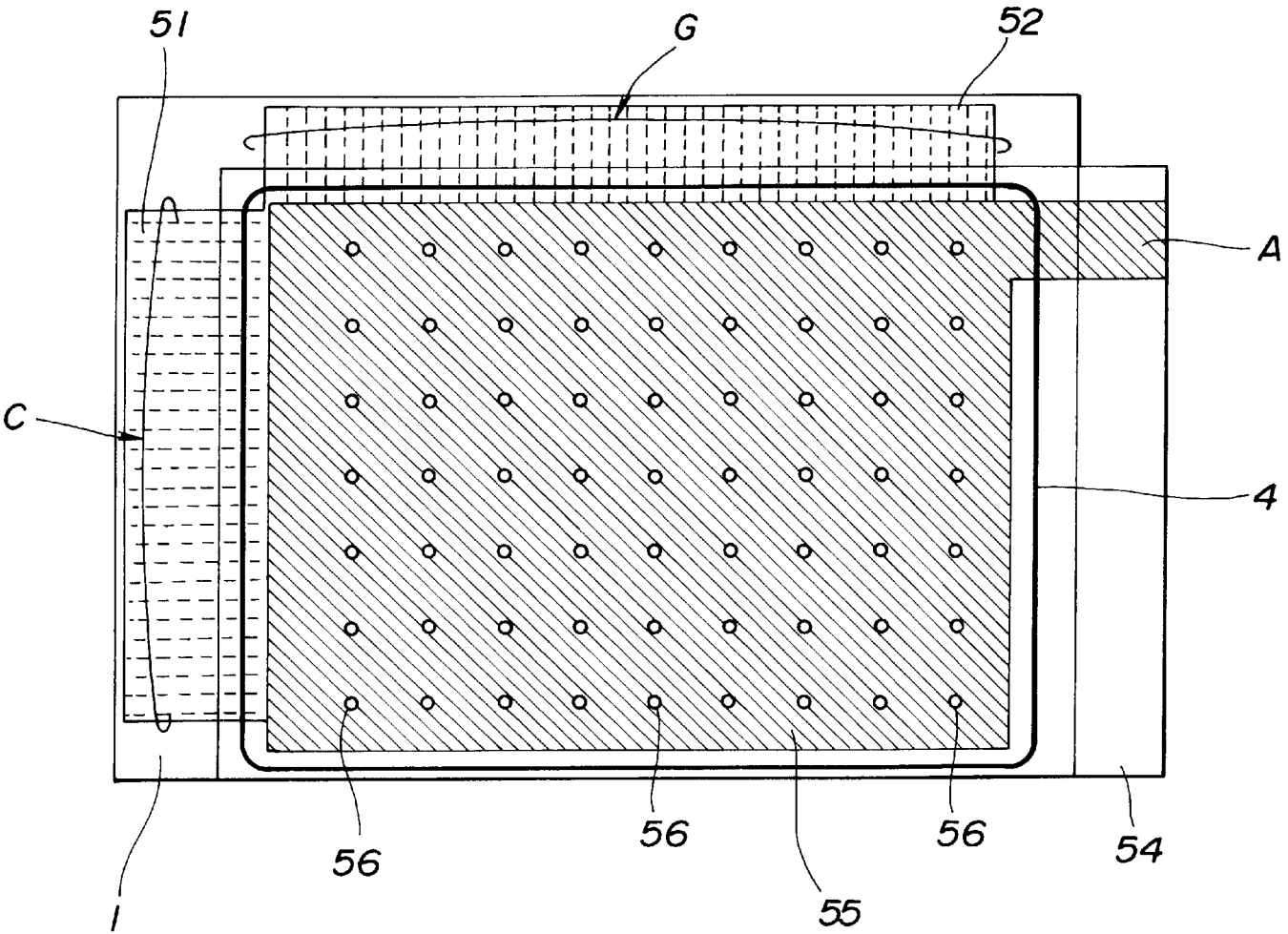
FIG. 7 is a schematic plan view showing a basic structure of the Spindt type FED of FIG. 6.
Figure 8:
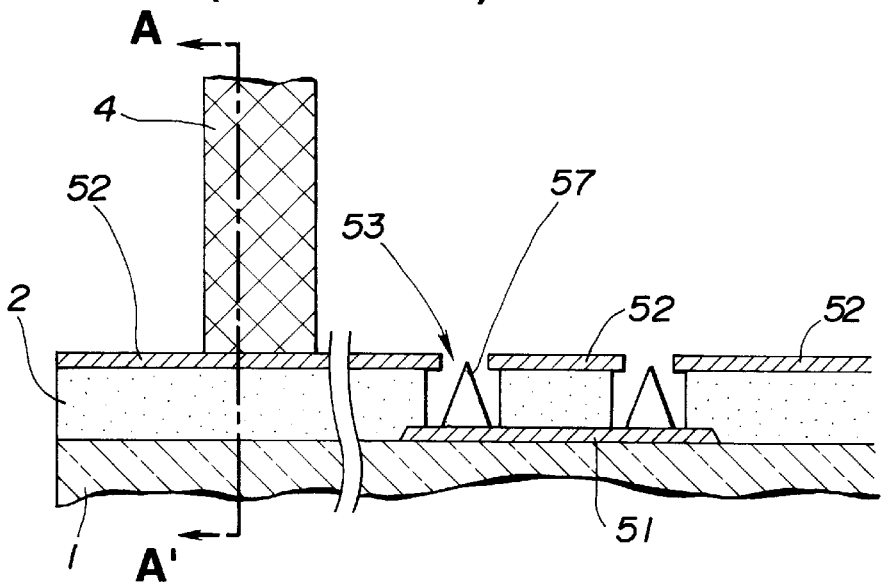
FIG.8 (PRIOR ART)
FIG. 8 is a schematic fragmentary sectional view showing an essential part of a first example of a conventional Spindt type FED.

The remaining part of the illustrated embodiment may be constructed in substantially the same manner as the Spindt type FED described above with reference to FIGS. 6 and 7 and has substantially the same sectional construction taken along one gate electrode as the first example of the prior art shown in FIG. 8. More specifically, the cathode substrate 1 on which an electron source including cathode electrodes formed with emitters of a conical shape, the gate electrodes 3 and the like is arranged is joined to the anode substrate including an anode electrode and a phosphor by welding using the seal material 4 while being kept spaced from the anode substrate at a predetermined interval. Also, the gate electrodes 3 are led out of a welded portion between the cathode substrate 1 and the anode substrate and the envelope is evacuated to a high vacuum, resulting in a vacuum envelope which has the electron source incorporated therein being provided.

In the illustrated embodiment, it is not required to form the whole gate electrode of a non-oxidizable material such as niobium oxide, niobium nitride or the like. It is merely required that at least a portion of the gate electrode extending through the welded portion between both substrates is made of the non-oxidizable material.

Figure 2:
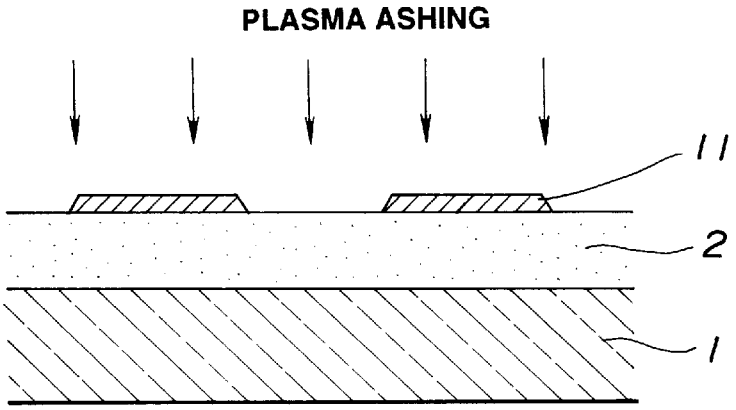
FIG. 2 is a schematic fragmentary sectional view showing an example of manufacturing of the vacuum envelope of FIG. 1.

Referring now to FIG. 2, manufacturing of the vacuum envelope of the illustrated embodiment is illustrated by way of example. Reference numeral 11 designates Nb films. The gate electrodes 3 shown in FIG. 1 may be manufactured by plasma ashing. The Nb films 11 are formed on the insulating film 2, followed by patterning. Then, when the niobium oxide film is to be formed, oxygen is activated in plasma, resulting in $O_2$ ashing for forced oxidation being carried out. When niobium nitride film is to be formed, $N_2$ ashing is likewise carried out.

Figure 3:
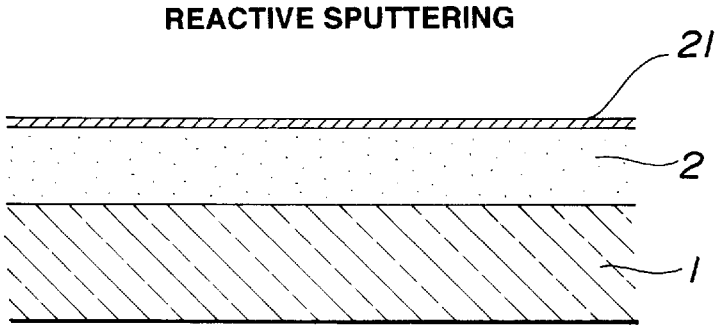
FIG. 3 is a schematic fragmentary sectional view showing another example of manufacturing of the vacuum envelope of FIG. 1.

Referring now to FIG. 3, a second example of manufacturing of the vacuum envelope of the illustrated embodiment is illustrated by way of example. In FIG. 3, reference numeral 21 designates a niobium oxide film or niobium nitride film. In the example, the gate electrode 3 shown in FIG. 1 may be formed by reactive sputtering. Formation of the niobium oxide film on the insulating layer 2 is carried out by reactive sputtering using $O_2$ and likewise that of the niobium nitride film thereon is carried out by reactive sputtering using $N_2$. Then, patterning is carried out, resulting in the gate electrodes 3 shown in FIG. 1 being formed.

Such formation of the niobium oxide film or niobium nitride may be carried out by any other suitable means such as, for example, reactive deposition. Alternatively, the oxidation or nitriding may be carried out by reactive ion etching (RIE). In general, etching is essentially used for removal of a material. However, when etching is used under reactive conditions while reducing an output of a unit for etching. Also, the oxidation or nitriding may be executed by chemical vapor deposition (CVD).

Figure 4:
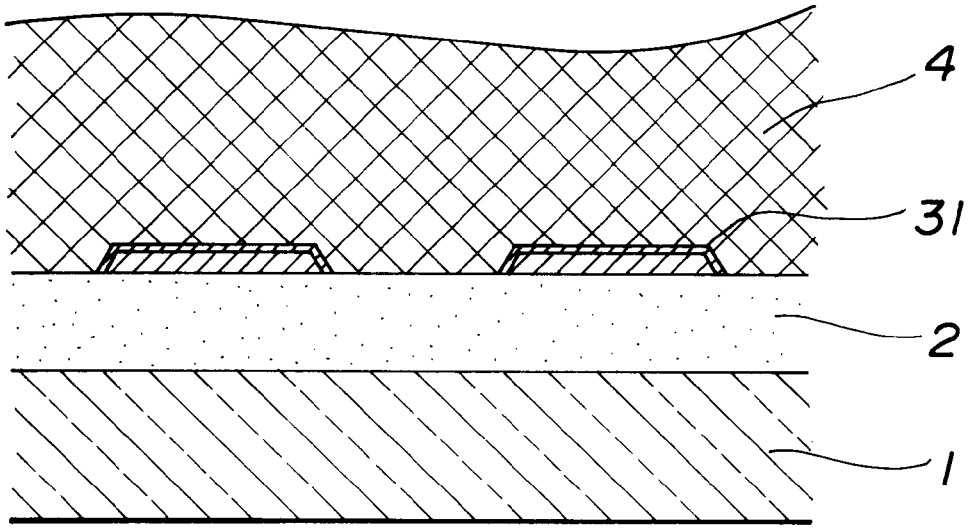
FIG. 4 is a schematic fragmentary sectional view showing an essential part of a second embodiment of a vacuum envelope with a built-in electron source according to the present invention.

Referring now to FIG. 4, a second embodiment of a vacuum envelope with a built-in electron source according to the present invention is illustrated. In FIG. 4, reference numeral 31 designates gate electrodes. In a vacuum envelope of the illustrated embodiment, a portion of each of the gate electrodes 31 contacted with a seal material 4 is made of niobium which was subject to oxidation or nitriding. Niobium oxide or niobium nitride is increased in resistivity, however, a decrease in thickness of the oxide or nitride restrains an increase in resistivity. It is not required to subject the whole gate electrode to a surface treatment for anti-oxidation. It is merely required to carry out the surface treatment on only a portion of the gate electrode 31 contacted with the seal material 4. The remaining part of the second embodiment may be constructed in substantially the same manner as the first embodiment described above.

Figure 5:
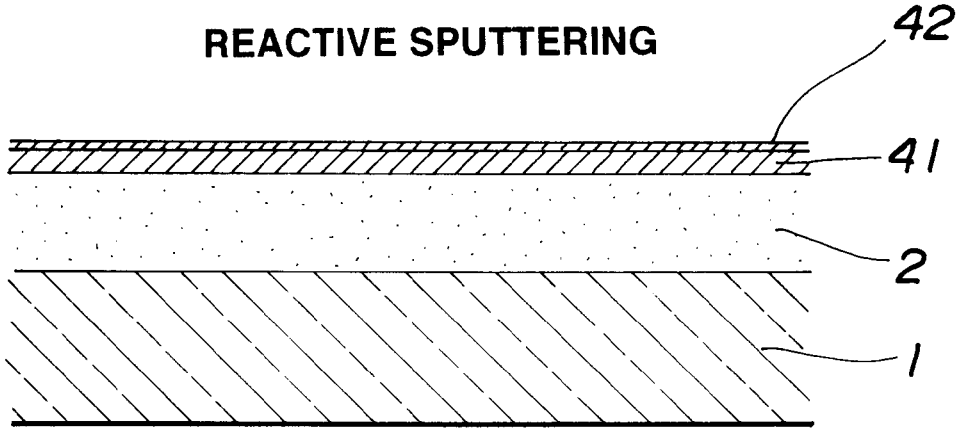
FIG. 5 is a schematic fragmentary sectional view showing manufacturing of the vacuum envelope of FIG. 2.

The vacuum envelope of the second embodiment thus constructed may be manufactured in such a manner as shown in FIG. 5. In FIG. 5, reference numeral 41 designates a niobium (Nb) film and 42 is an niobium oxide film or niobium nitride film. First, the Nb film 41 is formed on an insulating layer 2. When the niobium oxide film is to be formed, reactive sputtering using $O_2$ is carried out; whereas formation of the niobium nitride film is executed by reactive sputtering using $N_2$. This results in the niobium oxide film or niobium nitride film 42 being formed. Then, patterning is carried out, so that the gate electrodes 31 shown in FIG. 4 may be formed.

A thickness of the film prior to formation of the niobium oxide film or niobium nitride film 42 is between 0.2 $\mu$m and 0.4 $\mu$m. A thickness of the niobium oxide film 42 is required to be 50 Å or more. Natural oxidation likewise contributes to formation of the niobium oxide film 42. However, it restrains a thickness of the film 42 to a level below 50 Å, leading to a failure to prevent such peeling of the gate electrode as described above.

Figure 10:
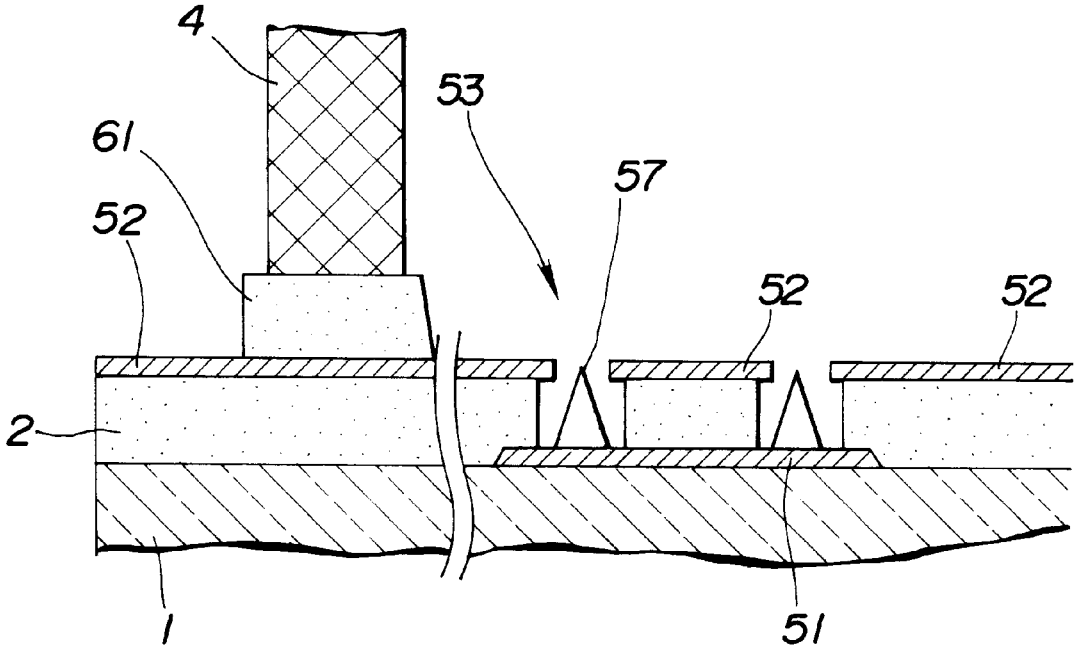
FIG.10 (PRIOR ART)
FIG. 10 a schematic fragmentary sectional view showing an essential part of a second example of a conventional Spindt type FED.

The embodiments described above with reference to FIGS. 1 and 4 each do not require such formation of any protective film and patterning as described above with reference to FIG. 10, to thereby reduce both the number of steps in manufacturing of the vacuum envelope and a manufacturing cost thereof. Although formation of the niobium oxide film or niobium nitride film requires time, manufacturing of the vacuum envelope of each of the embodiments generally reduces time required therefor. Further, the embodiments each eliminate a necessity of a mask for patterning of the protective film, leading to a reduction in manufacturing cost.

Figure 6:
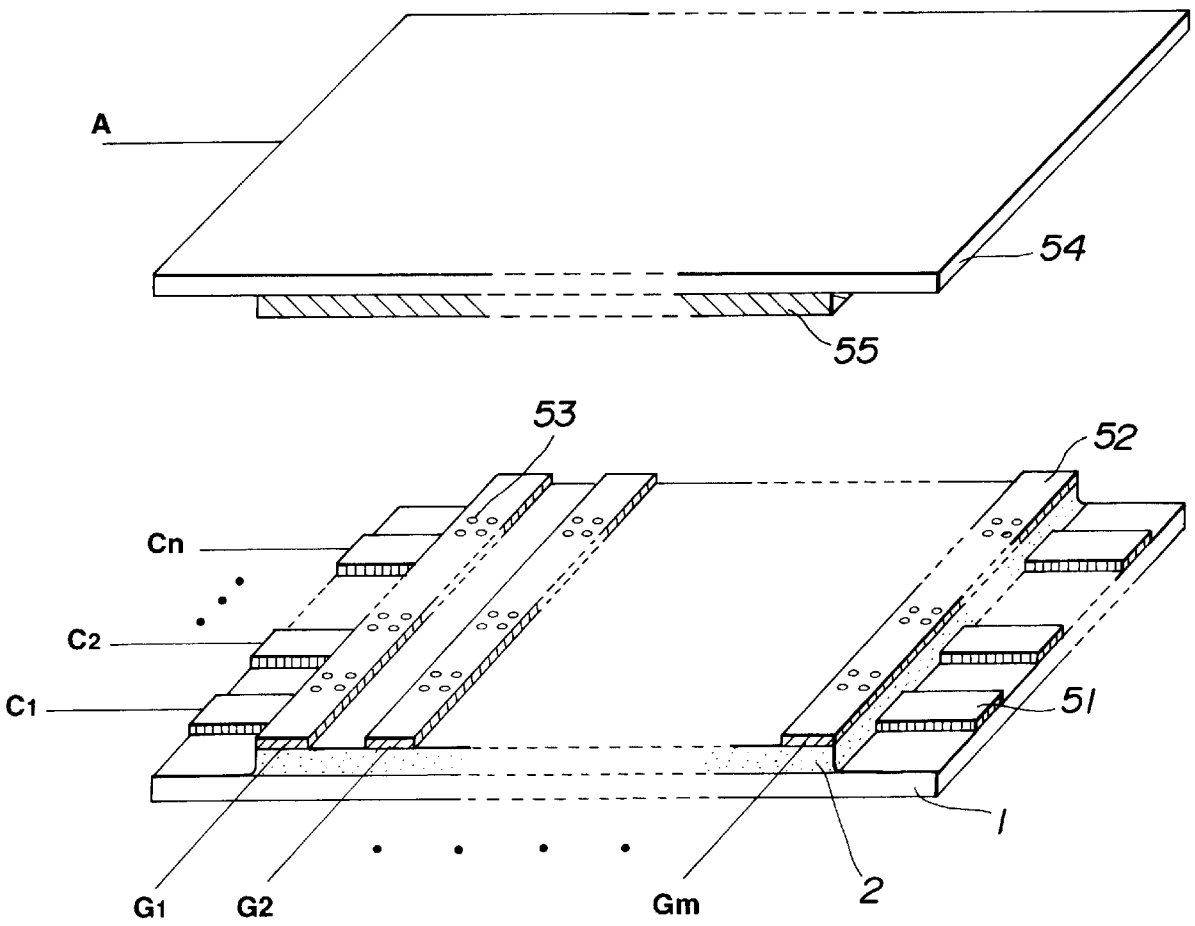
FIG. 6 is a schematic perspective view showing a basic structure of a Spindt type FED.

The above description has not been made on reaction between the anode electrode 55 and the seal material 4 shown in FIGS. 6 and 7. The anode electrode 55 is generally made of indium-tin oxide (ITO). Thus, the material is an oxide, resulting in free from the above-described problem encountered with Nb for the gate electrode 52. However, it is impossible to apply dry etching to ITO, therefore, ITO is not practicable for the gate electrode 52.

Also, the insulating layer 2 is interposed between the cathode electrodes 51 and the seal member 4, so that the cathode electrodes 51 are free from the above-described problem. Use of aluminum for the gate electrode 52 permits the problem to be eliminated. However, aluminum is used for a lift-off layer during formation of a conical emitter, therefore, it is impossible to use it for the gate electrode. Thus, niobium oxide or niobium nitride is suitable for use for the gate electrode 52.

The above description has been made on the Spindt type field emission cathode. However, a field emission cathode of any other suitable type or such a fine cold cathode element as described above may be suitably used in the present invention so long as it exhibits heat resistance sufficient to withstand heating for sealing by the seal material. Also, the present invention may be effectively applied to a vacuum envelope with a built-in electron source for an active element, a sensor, an electron beam unit or the like other than such a display device as described above. Also, the problem due to use of Nb for the gate electrode 52 has been described, however, peeling of the gate electrode may be prevented in substantially the same manner as described above also when a material which expands due to oxidation thereof like Nb may be used for the gate electrode 52.

As can be seen from the foregoing, the present invention effectively prevents peeling of the gate electrode, a failure in conduction thereof, breakage thereof and the like, to thereby permit the vacuum envelope to exhibit satisfactory reliability in operation over a long period of time while eliminating a necessity of arrangement of such a protective film as employed in the prior art. Thus, the present invention simplifies manufacturing of the vacuum envelope, eliminates a deterioration in process margin and prevents a reduction in yields.

While preferred embodiments of the invention have been described with a certain degree of particularity with reference to the accompanying drawings, obvious modifications and variations are possible in light of the above teachings. It is therefore to be understood that within the scope of the appended claims, the invention may be practiced otherwise than as specifically described.

What is claimed is:

1. A vacuum envelope with a built-in electron source, comprising:

a cathode substrate sealedly joined to another substrate by welding by means of a seal material to form a sealed space between said substrates;

said electron source including gate electrodes;

said gate electrodes being led out through a welded portion between said substrates;

said sealed space being evacuated to a vacuum atmosphere;

said gate electrodes each having at least a portion which passes through said welded portion made of niobium oxide.

2. A vacuum envelope with a built-in electron source, comprising:

a cathode substrate sealedly joined to another substrate by welding by means of a seal material to form a sealed space between said substrates;

said electron source including gate electrodes;

said gate electrodes being led out through a welded portion between said substrates;

said sealed space being evacuated to a vacuum atmosphere;

said gate electrodes each having at least a surface which is contacted with said seal material made of niobium oxide.

3. A method for manufacturing a vacuum envelope with a built-in electron source, comprising the steps of:

sealedly joining a cathode substrate to another substrate by welding by means of a seal material to form a sealed space between said substrates;

leading out gate electrodes of said electron source through a welded portion between said substrates; and evacuating said sealed space to a vacuum atmosphere;

said gate electrodes each being made by forming a niobium film, subjecting the niobium film to patterning and subjecting at least a surface of at least a portion of said niobium film contacted with said seal material to an oxidizing treatment.

4. A method for manufacturing a vacuum envelope with a built-in electron source, comprising the steps of:

sealedly joining a cathode substrate formed thereon with an electron source to another substrate by welding by means of a seal material to form a sealed space between said substrates;

leading out gate electrodes of said electron source through a welded portion between said substrates; and evacuating said sealed space to a vacuum atmosphere;

said gate electrodes each being made by forming a niobium film, subjecting at least a surface of at least a portion of said niobium film contacted with said seal material to an oxidizing or nitriding treatment and subjecting said niobium film to patterning.

* * * * *

UNITED STATES PATENT AND TRADEMARK OFFICE

CERTIFICATE OF CORRECTION

PATENT NO. : 5,955,832

DATED : September 21, 1999

INVENTOR(S): Masaharu TOMITA et al.

It is certified that an error appears in the above-identified patent and that said Letters Patent is hereby corrected as shown below:

On the title page, item [54], and at the top of Column 1, the title should be:

--VACUUM ENVELOPE DEVICE HAVING NIOBIUM OXIDE GATE ELECTRODE STRUCTURE--

Signed and Sealed this

First Day of May, 2001

*Attest:*

Nicholas P. Godici

NICHOLAS P. GODICI

*Attesting Officer*

*Acting Director of the United States Patent and Trademark Office*